United States Patent [19]

Hinz

[11] 4,239,247

[45] Dec. 16, 1980

[54] PORTABLE ANGLING HOUSE

[76] Inventor: James E. Hinz, Rte. 2, Box 98, Osakis, Minn. 56360

[21] Appl. No.: 21,436

[22] Filed: Mar. 16, 1979

[51] Int. Cl.[3] ..... E04B 1/347

[52] U.S. Cl. ..... 280/12 S; 135/4 R; 280/24; 296/171

[58] Field of Search ..... 280/12 S, 24, 20, 18, 280/656, 12 R; 180/190; 296/159, 160, 161, 170, 171, 173, 175, 176, 104, 105, 26; 135/4 R, 4 A, 1 R, 1 A

[56] References Cited

U.S. PATENT DOCUMENTS

| | | | |
|---|---|---|---|
| 2,546,588 | 3/1951 | Ellis | 280/20 |
| 2,632,454 | 3/1953 | Skogen | 280/20 |
| 2,862,719 | 12/1958 | Morz | 280/18 |
| 2,927,799 | 3/1960 | Schnitzer | 280/18 |
| 3,163,460 | 12/1964 | Cox | 296/173 |
| 3,464,735 | 9/1969 | Smith | 280/24 |
| 3,506,299 | 4/1970 | Arnold et al. | 296/170 |
| 3,507,293 | 4/1970 | DuBray | 135/4 R |
| 3,826,270 | 7/1974 | Hentges | 135/4 R |
| 3,923,335 | 12/1975 | Erickson | 296/158 |
| 4,088,363 | 5/1978 | Palmer | 296/161 |

*Primary Examiner*—David M. Mitchell

*Attorney, Agent, or Firm*—Clarence A. O'Brien; Harvey B. Jacobson

[57] ABSTRACT

An angling house for fishermen having a molded two-part telescoping base with runners formed in the base and a forwardly extending handle to facilitate towing the device along lakes, and the like. The house includes a folding top having a plurality of radially extending frame elements which are pivotally connected to a common point on one of the base halves. Material is disposed over the frame members to form an enclosed top for the house.

5 Claims, 10 Drawing Figures

60
14
10
58
62
4
18
4
12
16
29

36
34
20
22
24
67
12
16
26
28
63
64
66
38
30
32
65
40
38

16
30
18

58
44
46
48
6
42
50
52
36
56
34
40
6
38
64
30
22
20
20
58
42
52
50
36
56
40
34
38
16

PORTABLE ANGLING HOUSE

BACKGROUND OF THE INVENTION

1. Field of the Invention

This invention relates to portable structures used to provide protection from the elements for a sportsman engaged in ice fishing.

2. Description of Related Art

When engaging in the sport of ice fishing, the sportsman must often be required to remain in a fixed position over an extended period of time in the center of a frozen lake or pond. The temperature in such a location must necessarily be quite low and the position assumed in the center of a lake leaves a large, open area surrounding the sportsman across which wind may travel to make the effective temperature surrounding the sportsman still lower. Accordingly, some form of shelter is required which can be easily moved to the location and quickly erected to provide protection for the sportsman against the elements.

Certain prior art devices have been suggested to fill such a need. U.S. Pat. No. 2,464,884, issued Mar. 22, 1949, to Noyes, shows a shelter comprising a pair of fixed runners having pin receiving structures for supporting frame members and a flexible covering for disposition over the frame members. U.S. Pat. No. 2,473,076, issued June 14, 1949, to Scheibner, shows a collapsible ice fishing structure having a sled with a pair of runners and a collapsible frame mounted on the sled. The frame comprises four upright corner sections and a rigid roof frame hingedly connected to the upper ends of the upright sections. The frame is mounted so that it may be collapsed entirely within the confines of the sled. U.S. Pat. No. 2,546,588, issued Mar. 27, 1951, to Ellis, shows a collapsible fishing shelter having a floor structure mounted on a pair of ice runners which are swingable between a horizontal position and a vertical position beneath the floor structure for moving the structure. U.S. Pat. No. 3,578,003, issued May 11, 1971, to Everett, shows a portable platform characterized by a low-lying rigid but lightweight frame suspending a canvas floor. A rigid shape imparting framework is disposed over the floor and covered with a flexible tent material having flaps at either end.

SUMMARY OF THE INVENTION

The present invention includes a two-piece, molded, telescoping base structure. The outer portion of the telescoping base includes a pair of runners molded into the base and a raised center portion having a hole disposed therein for communicating with the ice. The inner portion of the telescoping base is shaped similar to the outer portion so as to enable it to fit snugly within the outer portion. The inner portion includes a pair of pivot joints to which are attached four frame members which can be pivoted through an arc about the base. A flexible top is connected to the frame members and can be quickly erected by pivoting the frame members about the base. The inner base member also includes a hole at one end for communicating the interior of the shelter with the ice. To place the shelter in its erect position, the two base members are extended and the frame members are pivoted and held in place at one end of each base member. This provides an adequate shelter for two men to ice fish within. To fold the shelter, the top is pivoted about its connection to the inner base member and disposed entirely within the inner base member. The inner base member is then slid within the outer base member thereby providing a compact configuration making the shelter easily portable. The outer base member can be disconnected from the inner base member to be used as a separate sled or can be associated with a second top for providing a spear fishing shelter.

Accordingly, one object of the present invention is to provide a portable angling house which is relatively light and compact in form when in its folded position thereby facilitating the transportation thereof yet large enough to accommodate two men when in its erect position.

A further object of the present invention is to provide a portable angling house having a molded base portion with a pair of runners and a raised section between the runners wherein the fishing holes are located so as to avoid contact of the holes with snow when the base is being towed.

A further object of the present invention is to provide a portable angling house having a minimum cubic air space within it for allowing the house to be heated with a small energy heater.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
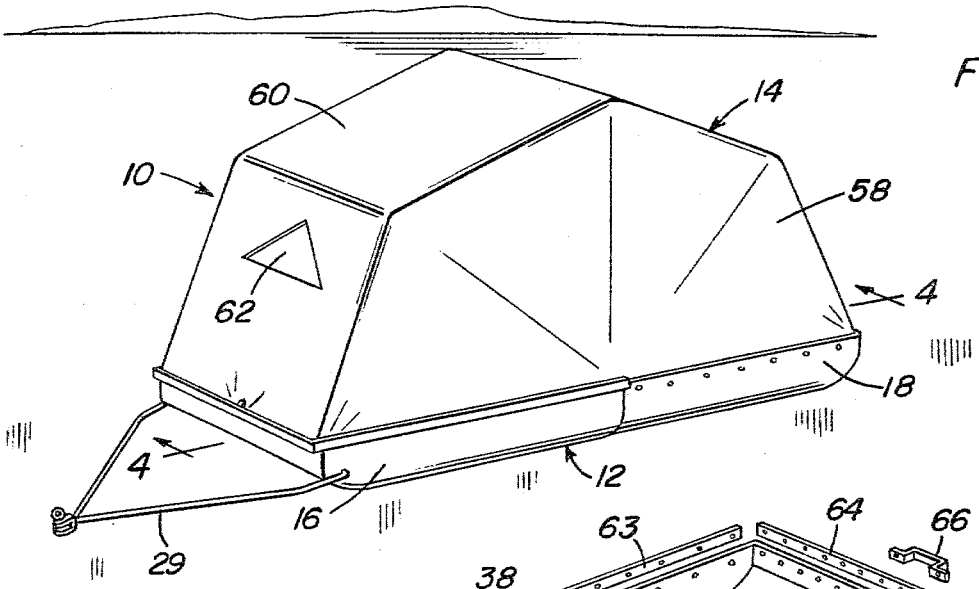
FIG. 1 is a perspective view of the portable angling house in its erected position.
Figure 2:
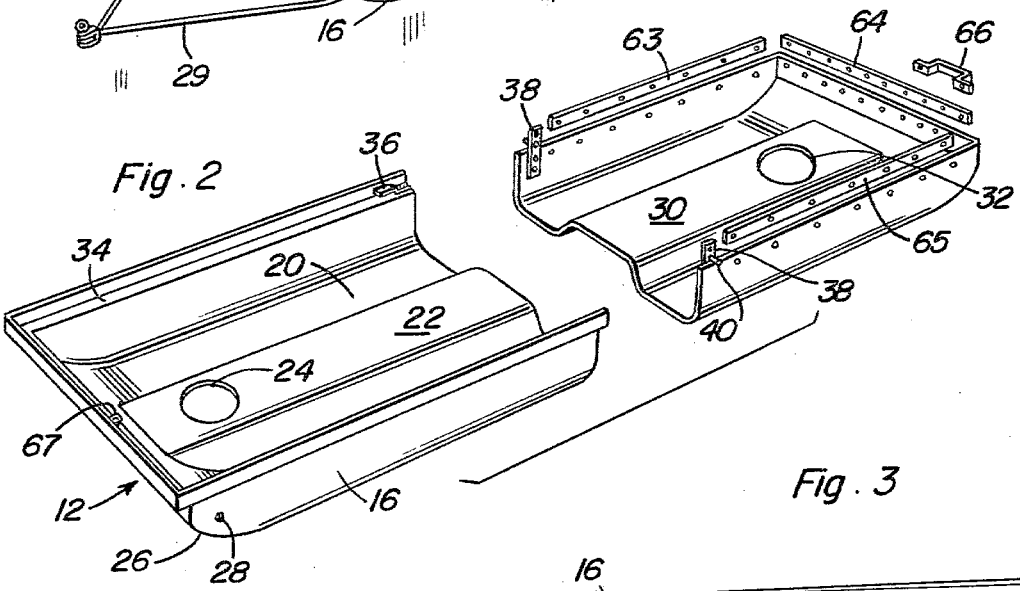
FIG. 2 is an exploded view of the portable angling house base portion.

Now with reference to the drawings, the portable angling house of the present invention, generally referred to by the numeral 10, will be set forth in detail. Specifically, with reference to FIGS. 1 through 6, it can be seen that the angling house 10 comprises a base portion 12 and a top portion 14.

Figure 3:
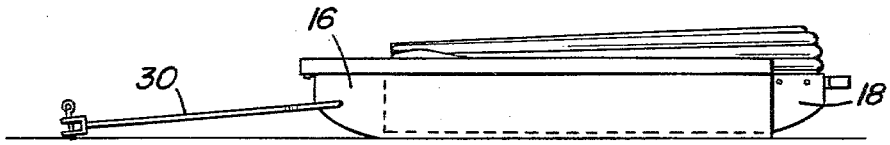
FIG. 3 is a side elevational view of the portable angling house in its folded position.
Figure 5:
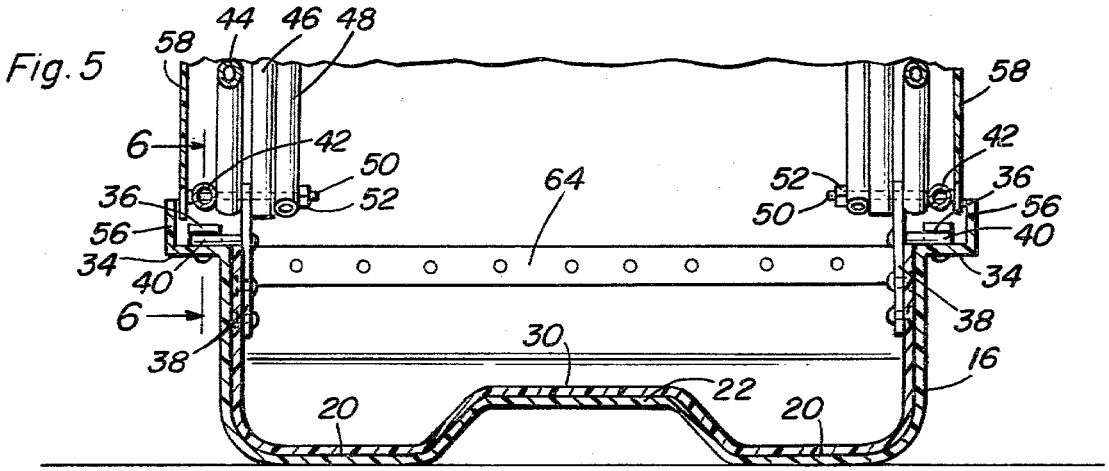
FIG. 5 is an end elevational sectional view of the portable angling house taken substantially along a plane passing through section line 5—5 of FIG. 4.
Figure 6:
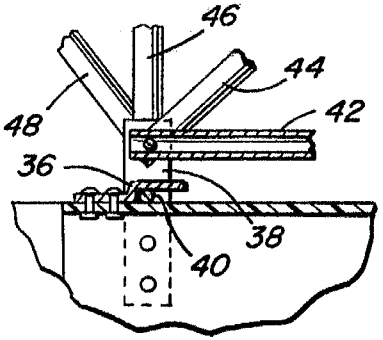
FIG. 6 is a side elevational sectional view taken substantially along a plane passing through section line 6—6 of FIG. 5 showing the pivot connection of the angling house top.
Figure 4:
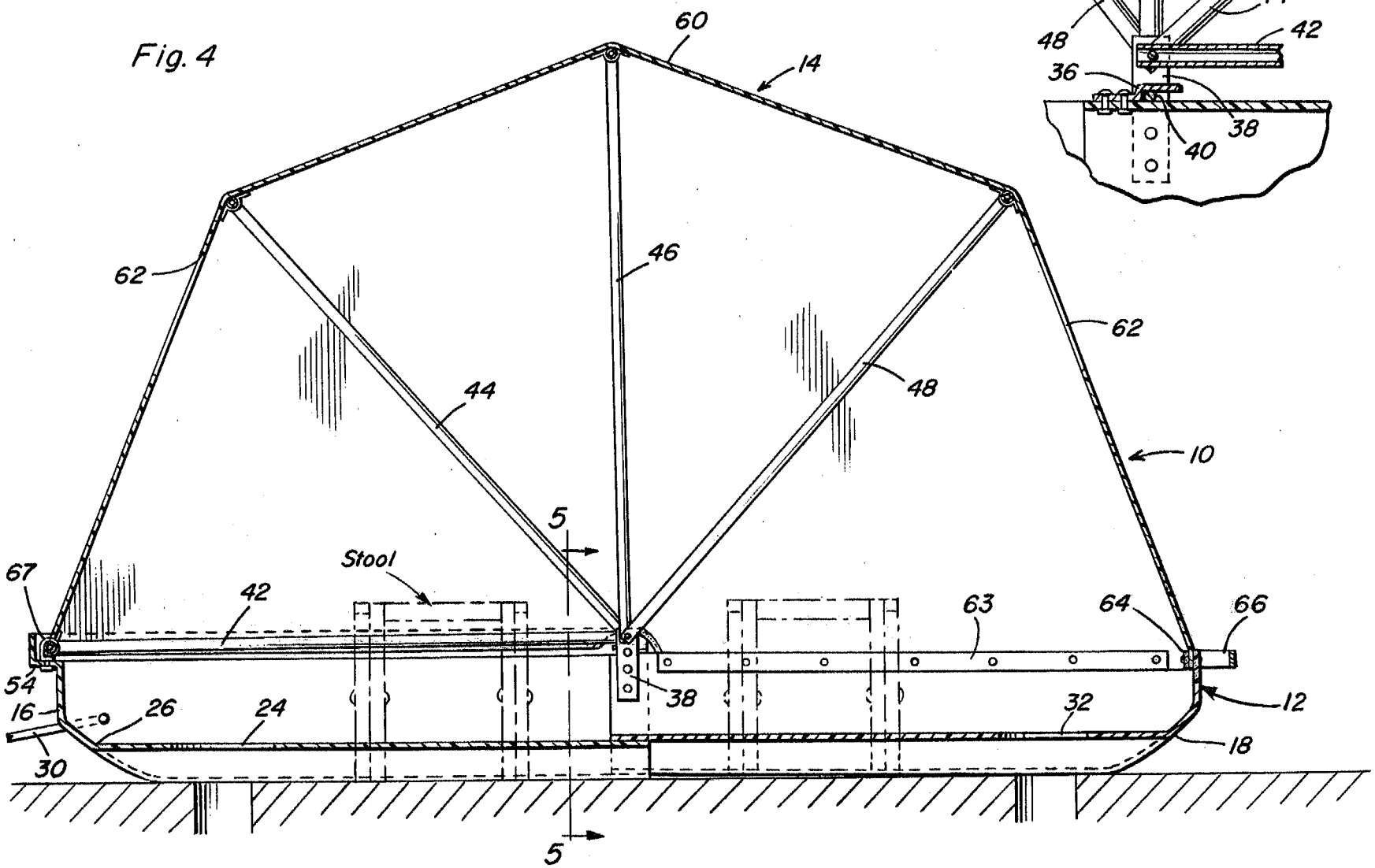
FIG. 4 is an elevational sectional view of the portable angling house taken substantially along a plane passing through section line 4—4 of FIG. 1.
Figure 7:
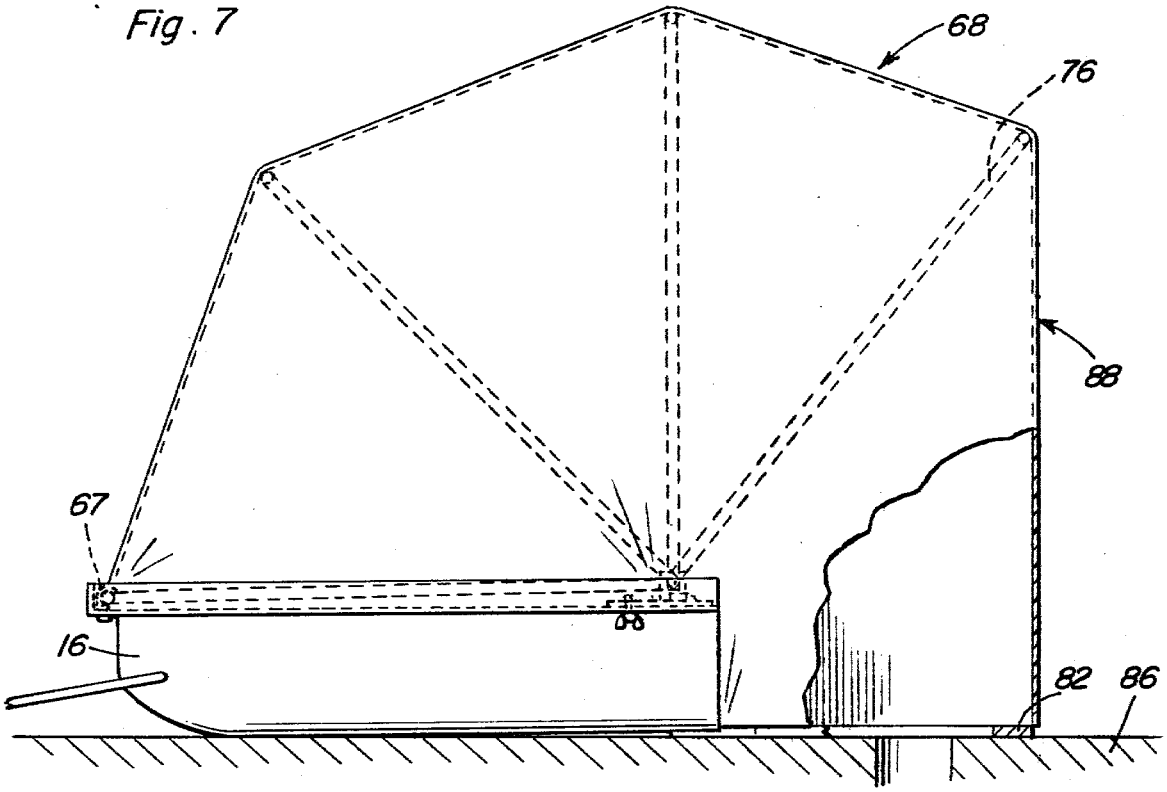
FIG. 7 is a side elevational view of the spear house embodiment of the present invention.
Figure 8:
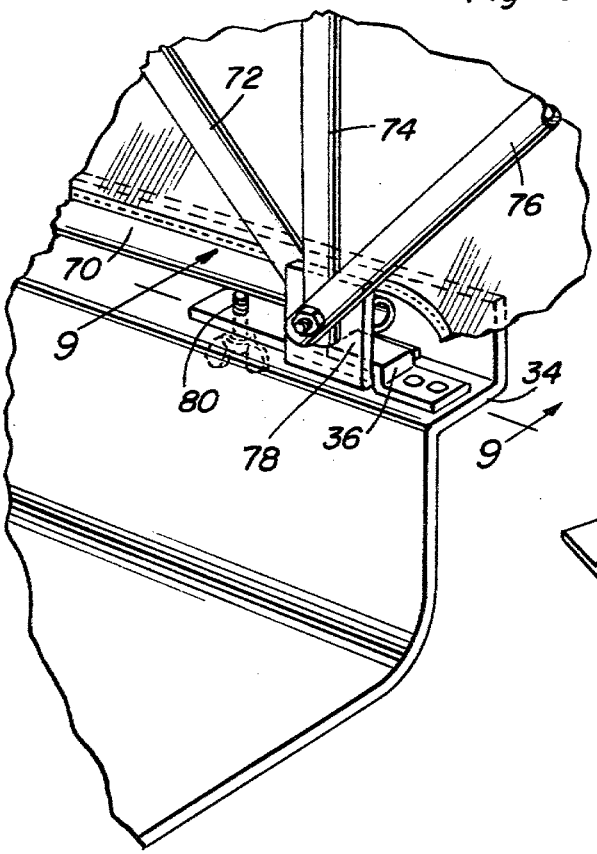
FIG. 8 is a perspective view of the pivot connection for the top of the spear house embodiment.
Figure 9:
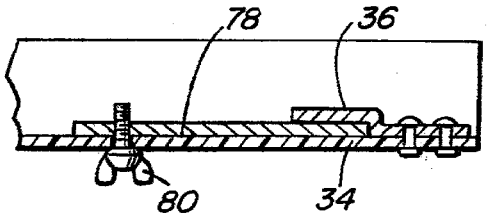
FIG. 9 is a side elevational view taken substantially along a plane passing through section line 9—9 of FIG. 8.
Figure 10:
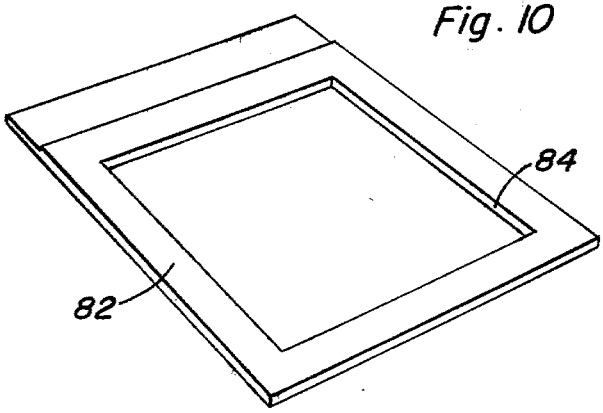
FIG. 10 is a perspective view of the additional base section used in the spear house embodiment of the invention.

The base portion 12 has two telescoping sections. The sled section 16 is the outer member of the base portion and receives similarly shaped inner section 18 in a telescopic manner. The sled section 16 is approximately 4 feet in length and 30 inches wide. It is made from molded fiberglass or plastic and includes molded runners 20 with a raised center portion 22 disposed between the runners. Each runner is approximately 6½ inches wide which provides sufficient floor space to set a lantern in. The raised center 22 includes angling hole 24. This section is raised approximately 2½ inches so that the angling hole does not drag along the ground when the shelter is being towed. The sled section 16 also has an upwardly curved front wall 26 and a pair of side walls each of which contains a small hole 28 for receiving tow bar 29 which is used to pull the sled or tow it behind a snowmobile, or the like. The inner section 18 has a shape somewhat symmetrical to that of sled section 16 and includes raised center 30 having a second angling hole 32 disposed therein. Section 18 can be telescopically received within section 16, as seen in FIG. 3, to give an over-all length of approximately 4 feet 8 inches to the angling house. Alternatively, section 18 can be turned 180° thus having its forward curved wall contact the forward curved wall of section 16 and thereby providing a compact configuration having a length of only 4 feet. Additionally, sled section 16 has laterally extending side flanges 34, each of which has attached thereto one raised bracket 36. The inner section 18 has a pair of upstanding mounts 38 connected to each lateral side thereof. Each mount 38 includes a laterally extending pin 40 which cooperates with the raised bracket 38 of the sled section and slides thereunder to stop the extension of inner section 18 from sled section 16 during erection of the shelter. Furthermore, when the shelter is in its erect position, the entire house can be moved from one position on the ice to another by pulling tow bar 29 with the cooperation of elements 36 and 40 insuring that the inner section 18 will be pulled behind the sled section 16.

The top 14 includes four frame members 42, 44, 46 and 48. Each frame member has a generally inverted U-shaped configuration with its ends pivotally connected to the top of mounts 38 by the use of bolts 50 and nuts 52. Connected to the frame members is a fabric cover having sides 58 made from nylon and center top section 60 made from canvas and including window 62 therein. The covering includes a canvas center top portion to insure adequate ventilation within the structure when assembled. The center top is fixedly attached to one end of inner section 18 by attachment bar 64 which is riveted to the inside of the rear wall of section 18 with the center top portion being disposed therebetween. The nylon sides 58 are likewise fastened to section 18 by attachment bars 63 and 65. Also, a carrying handle 66 is connected over bar 64 for providing a separate means of lifting telescoping, and carrying the inner section 18. The frame members are connected to the center top portion at spaced positions therealong with frame member 42 being attached at the free end of the top. When assembled, frame member 42 is brought to rest within the channel of sled section 16 defined by flanges 34 and 54 and upstanding perimetric ridge 56. A small hook or clip 67 is attached to flange 54 and is disposed over frame member 42 for holding it in place. Accordingly, it can be seen that erected angling house provides sufficient room for enclosing two fishermen, their stools shown in phantom in FIG. 4, and a small lantern to provide light and heat. The structure can easily be disassembled by disconnecting hook 68 from frame member 42, at which time the top is folded down on itself into inner section 18 of the base portion and the base portion section 18 is pushed forwardly into section 16, as shown in FIG. 3. When telescopically received in this manner, both angling holes are covered by the adjacent portion of the opposite base half, enclosing unit bottom.

FIGS. 7 through 10 show a second embodiment of the angling house for use in spear fishing. This second embodiment includes the same sled portion 16 as used in angling house 10. In combination with the sled portion 16 is top 68 which again includes four frame members 70, 72, 74 and 76 which are identical in shape and function to frame members 42, 44, 46 and 48. However, frame members 70, 72, 74 and 76 are attached to adapter plate 78 which slides beneath raised bracket 36 and is secured thereunder by thumb screw 80 which passes up through flange 34. In place of inner portion 18, a spear hole frame 82 is provided and positioned beneath said portion 16. Frame 82 has an enlarged opening 84 which is disposed directly on ice 86 for surrounding a hole in the ice. The covering for the top 68 is similar to the covering of top 14 except that the covering for top 68 includes extra long center and side portions shown generally at 88 which and depend from frame member 76 and surround the spear frame 82. When the spear house is to be disassembled, the spear frame 82 can be pivoted into sled section 16, the top 68 folding down onto itself completely within the confines of section 16 thereby facilitating transportation of the unit.

It should be noted that the sled portion 16 can be used without any top porton whatsoever as a means for transporting items across the ice. For this purpose, a rear portion could easily be constructed, thus providing a totally enclosed sled.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable, collapsible angling house comprising, in combination:

a base portion comprising a first section and a second section, said second section being received in said first section when the angling house is in its collapsed configuration and said second section extending from said first section when the angling house is in its erect configuration, and a pair of runners formed in said first section positioned longitudinally of said first section and on either side of a raised central area of said first section, a first angling hole disposed in said central raised section of said first base portion for communicating the interior of said angling house with a support surface;

a top structure comprising a plurality of frame members radially extending from a common mounting position disposed on one of said base sections and foldable into that section; and fabric covering attached to said frame members, said second section having a configuration similar to said first section with a pair of runners disposed on either side of a raised center portion and a second angling hole disposed in the raised center portion of said second section.

2. The combination of claim 1 and further wherein said first and second base sections include cooperating stop elements for limiting the extension of said second base section from said first base section.

3. The combination of claim 1 wherein each of said runners is approximately six inches in width.

4. The combination of claim 3 and further including a tow bar means pivotally attached to one of said base sections.

5. The combination of claim 1 wherein said top cover has one end fixedly attached to one of said base members and an opposite end which is removably attached to the other of said base members.

* * * * *